US008982027B2

(12) United States Patent
He et al.

(10) Patent No.: US 8,982,027 B2
(45) Date of Patent: Mar. 17, 2015

(54) LCD DRIVE CIRCUIT AND DRIVING METHOD FOR SCANNING AT LEAST TWO ADJACENT SCAN LINES SIMULTANEOUSLY

(75) Inventors: Chengming He, Shenzhen (CN); Hung-Lung Hou, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 250 days.

(21) Appl. No.: 13/375,443

(22) PCT Filed: Aug. 8, 2011

(86) PCT No.: PCT/CN2011/078116

§ 371 (c)(1),
(2), (4) Date: Nov. 30, 2011

(87) PCT Pub. No.: WO2013/013420

PCT Pub. Date: Jan. 31, 2013

(65) Prior Publication Data

US 2013/0027363 A1 Jan. 31, 2013

(30) Foreign Application Priority Data

Jul. 28, 2011 (CN) ..... 2011 1 0213867

(51) Int. Cl.
*G09G 3/36* (2006.01)

(52) U.S. Cl.
CPC ..... *G09G 3/3648* (2013.01); *G09G 3/3677* (2013.01); *G09G 2310/0205* (2013.01); *G09G 2310/0218* (2013.01)
USPC ..... 345/94

(58) Field of Classification Search
CPC ..... G09G 3/3266; G09G 2310/021; G09G 2310/0205; G09G 2310/0208
USPC ..... 345/204, 87, 212, 213, 98–100, 55
See application file for complete search history.

(56) References Cited

U.S. PATENT DOCUMENTS

| | | | | |
|---|---|---|---|---|
| 5,347,294 | A * | 9/1994 | Usui et al. | 345/89 |
| 6,903,716 | B2 * | 6/2005 | Kawabe et al. | 345/99 |
| 6,924,808 | B2 * | 8/2005 | Kurihara et al. | 345/506 |
| 7,079,103 | B2 * | 7/2006 | Morita | 345/98 |
| 7,209,109 | B2 * | 4/2007 | Furuichi | 345/98 |
| 7,633,476 | B2 * | 12/2009 | Sakaguchi | 345/89 |
| 2006/0156120 | A1 * | 7/2006 | Kim | 714/726 |
| 2007/0001991 | A1 | 1/2007 | Jang et al. | |

FOREIGN PATENT DOCUMENTS

| | | | |
|---|---|---|---|
| CN | 1501342 | A | 6/2004 |
| CN | 1877406 | A | 12/2006 |
| CN | 101261801 | A | 9/2008 |

* cited by examiner

*Primary Examiner* — Ram Mistry

(74) *Attorney, Agent, or Firm* — Cheng-Ju Chiang

(57) ABSTRACT

A liquid crystal display (LCD) drive circuit and a driving method thereof are disclosed. The driving method comprises: a. dividing scan lines into a plurality of groups each comprising a plurality of scan lines; b. during displaying of a current image frame, using a scan driver to scan each group of scan lines sequentially, c. during displaying of a next image frame, using the scan driver to scan each group of scan lines sequentially; and d. if each scan line in the group has been scanned once simultaneously with an adjacent scan line within a predetermined time interval, then the step b is executed; otherwise, the step c is executed. The LCD drive circuit and the driving method thereof according to the present disclosure can increase an average charging time of pixel units without compromising the accuracy of image frames.

9 Claims, 6 Drawing Sheets

LCD DRIVE CIRCUIT AND DRIVING METHOD FOR SCANNING AT LEAST TWO ADJACENT SCAN LINES SIMULTANEOUSLY

FIELD OF THE INVENTION

The present disclosure generally relates to the technical field of liquid crystal displays (LCDs), and more particularly, to an LCD drive circuit and a driving method thereof.

BACKGROUND OF THE INVENTION

As liquid crystal display (LCD) devices develop towards a low cost, a light weight, a low power consumption and high reliability, LCDs using a plurality of gate drive chips and a plurality of source drive chips have been developed. In such an LCD, scan signals are provided by the plurality of gate drive chips, data signals are provided by a plurality of source drive chips, and signal line patterns are formed on a glass substrate.

The LCD comprises a liquid crystal panel, which is formed by an upper substrate, an intermediate liquid crystal layer and a lower substrate in combination. The liquid crystal panel comprises a plurality of data lines arranged in a column direction and a plurality of scan lines arranged in a row direction. A plurality of thin-film transistors (TFT switches) are disposed in the form of an array at intersections between the plurality of data lines and the plurality of scan lines, and liquid crystal capacitors are formed between the TFTs and a common electrode.

Due to the delay of the data signals and the scan signals caused by resistances of the data lines and the scan lines in the liquid crystal panel, the pulse width of the gate driving signals is reduced and the charging time of the TFT switches is shortened. As the LCD devices are developing towards a high resolution and a high frame rate, the aforesaid problem leads to a shortened average charging time of the TFT switches within a period, thus resulting in degradation of the image frame quality.

SUMMARY OF THE INVENTION

A primary objective of the present disclosure is to provide a liquid crystal display (LCD) drive circuit and a driving method thereof which can increase an average charging time of TFT switches within a period.

To achieve this objective, the present disclosure provides a liquid crystal display (LCD) drive circuit, which comprises:

a data driver, a scan driver, a divider, a controller, a plurality of data lines and a plurality of scan lines;

the scan driver is connected to the plurality of scan lines;

the data driver is connected to the plurality of data lines;

the divider is configured to divide the scan lines into a plurality of groups each comprising a plurality of scan lines; and the controller is configured to control the scan driver to, during scanning of each group of scan lines, scan at least two adjacent scan lines in the group simultaneously, and also control the scan driver in such a way that the at least two adjacent scan lines scanned simultaneously within a predetermined time interval are different for different image frames and positions of the at least two adjacent scan lines scanned simultaneously in each image frame are shifted downwards by at least two scan lines from those scanned simultaneously in a previous image frame, wherein the predetermined time interval is in units of image frame durations, and a magnitude of the predetermined time interval is equal to the number of scan lines in each group divided by the number of scan lines scanned simultaneously.

Preferably, the divider is configured to divide the scan lines into a plurality of groups each comprising eight scan lines, and the controller is configured to control the scan driver to, during scanning of each group of scan lines, scan two adjacent scan lines in the group simultaneously and also control the scan driver in such a way that every two adjacent scan lines scanned simultaneously in four consecutive image frames is different from each other.

Preferably, the controller is configured to control the scan driver in such a way that, within the four consecutive frames, positions of the two adjacent scan lines scanned simultaneously in each of the image frames are shifted downwards by two scan lines from those of a previous image frame.

To achieve the aforesaid objective, the present disclosure further provides an LCD drive circuit, which comprises a data driver, a scan driver, a divider, a controller, a plurality of data lines and a plurality of scan lines. The scan driver is connected to the plurality of scan lines; the data driver is connected to the plurality of data lines; the divider is configured to divide the scan lines into a plurality of groups each comprising a plurality of scan lines; and the controller is configured to control the scan driver to, during scanning of each group of scan lines, scan at least two adjacent scan lines in the group simultaneously, and also control the scan driver in such a way that the at least two adjacent scan lines scanned simultaneously within a predetermined time interval are different for different image frames.

Preferably, the predetermined time interval is in units of image frame durations, and a magnitude of the predetermined time interval is equal to the number of scan lines in each group divided by the number of scan lines scanned simultaneously.

Preferably, the controller is configured to control the scan driver in such a way that, within the predetermined time interval, positions of the at least two adjacent scan lines scanned simultaneously in each image frame are shifted downwards by at least two scan lines from those scanned simultaneously in a previous image frame.

Preferably, the divider is configured to divide the scan lines into a plurality of groups each comprising eight scan lines, and the controller is configured to control the scan driver to, during scanning of each group of scan lines, scan two adjacent scan lines in the group simultaneously and also control the scan driver in such a way that every two adjacent scan lines scanned simultaneously in four consecutive image frames is different from each other.

Preferably, the controller is configured to control the scan driver in such a way that, within the four consecutive frames, positions of the two adjacent scan lines scanned simultaneously in each of the image frames are shifted downwards by two scan lines from those of a previous image frame.

To achieve the aforesaid objective, the present disclosure provides an LCD driving method, comprising the following steps of:

a. dividing scan lines into a plurality of groups each comprising a plurality of scan lines;

b. during displaying of a current image frame, using a scan driver to scan each group of scan lines sequentially, wherein for each group of scan lines, the scan driver is controlled by a controller to scan at least two adjacent scan lines in the group simultaneously and scan other scan lines in the group sequentially;

c. during displaying of a next image frame, using the scan driver to scan each group of scan lines sequentially, wherein for each group of scan lines, the controller controls the scan driver in such a way that the at least two scan lines scanned simultaneously are different from those scanned simultaneously in the previous image frame; and d. if each scan line in the group has been scanned once simultaneously with an adjacent scan line within a predetermined time interval, then the step b is executed; otherwise, the step c is executed.

In the step d, the predetermined time interval is in units of image frame durations, and a magnitude of the predetermined time interval is equal to the number of scan lines in each group divided by the number of scan lines scanned simultaneously.

Preferably, in the step c and the step d, the controller controls the scan driver in such a way that positions of the scan lines scanned simultaneously are shifted downwards by at least two scan lines from those scanned simultaneously in the previous image frame, and if the last scan line of the scan lines scanned simultaneously is the last one in the group, then the step d is executed; otherwise, if the last scan line of the scan lines scanned simultaneously is not the last one in the group, then the step c is executed.

Preferably, in the step b, the controller controls the scan driver to scan a first scan line and a second scan line in the group simultaneously and scan other scan lines in the group sequentially; and in the step c, the controller controls the scan driver in such a way that positions of the scan lines scanned simultaneously are shifted downwards by two scan lines from the previous image frame.

Preferably, in the step a, the scan lines are divided into a plurality of groups each comprising eight scan lines.

The present disclosure has the following benefits: as compared to the prior art where delay of data signals and scan signals is caused by resistances of data lines and scan lines to result in a too narrow pulse width of the gate driving signals and a too short charging time of the TFT switches, the present disclosure has at least two adjacent scan lines scanned simultaneously in each image frame. Thus, the number of scannings in each image frame is reduced and the average scanning time of the scan lines is increased, thereby resulting in an increased charging time of pixel units. Furthermore, every two scan lines scanned simultaneously within a predetermined time interval are scanned simultaneously in only a single image frame and are scanned separately in other image frames; because the time is very short, the frames perceived by the user's eyes can still be kept accurate without being perceived to have errors.

DETAILED DESCRIPTION OF THE INVENTION

The present disclosure is more particularly described in the following examples that are intended as illustrative only since numerous modifications and variations therein will be apparent to those skilled in the art.

Figure 1:
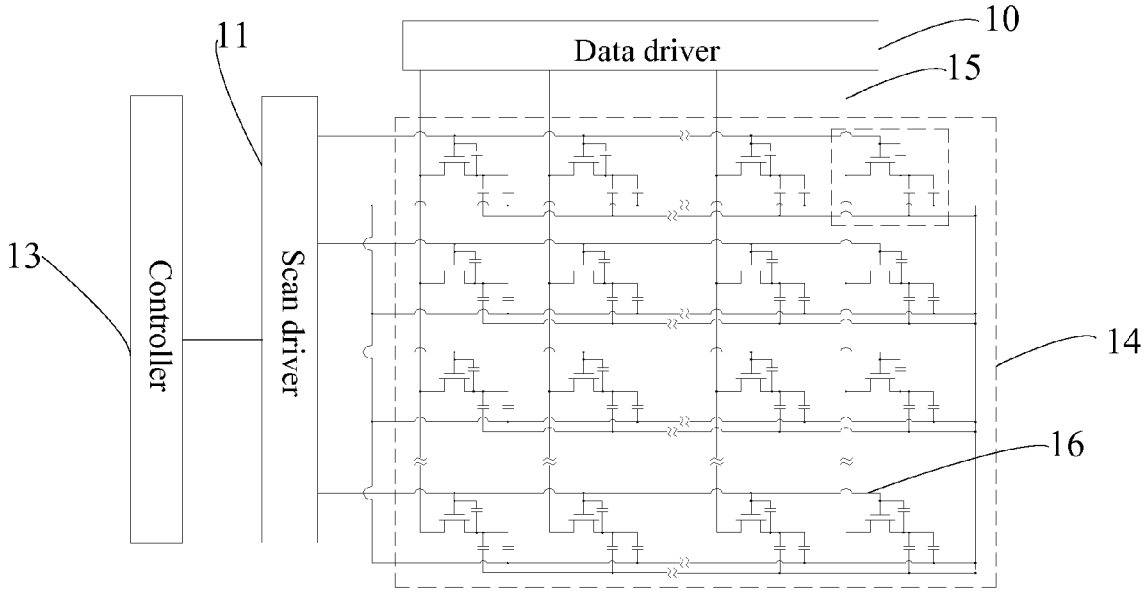
FIG. 1 is a schematic view of a preferred embodiment of an LCD drive circuit according to the present disclosure.

Referring to FIG. 1, there is shown a schematic view of a preferred embodiment of an LCD drive circuit according to the present disclosure. The LCD drive circuit comprises a data driver 10, a scan driver 11, a divider (not shown), a controller 13, a TFT switch array 14, a plurality of data lines 15 and a plurality of scan lines 16. The scan lines 16 and the data lines 15 are disposed to intersect with each other. The TFT switch (not labeled) is disposed near each intersection, and all the TFT switches together form the TFT switch array 14. The scan driver 11 is connected to the plurality of scan lines 16 to sequentially scan the scan lines 16. The data driver 10 is connected to the plurality of data lines 15 to supply a grayscale voltage for each of the data lines 15. The divider is configured to divide the scan lines 16 into a plurality of groups, each group comprises a plurality of scan lines 16. The controller 13 is configured to control the scan driver 11, and during scanning of each group of scan lines 16, the scan driver 11 scan two adjacent scan lines 16 of the group simultaneously. The controller 13 also control the scan driver 11 in such a way that, within a predetermined time interval, positions of every two adjacent scan lines 16 scanned simultaneously in an image frame is shifted downwards by two scan lines 16 from those scanned simultaneously in a previous image frame. The predetermined time interval is in units of image frame durations, and a magnitude thereof is equal to the number of the scan lines 16 in each group divided by the number of the scan lines that are simultaneously scanned. For example, if each group comprises six scan lines 16, then the predetermined time interval is equal to a duration of three (i.e., six divided by two) image frames.

Figure 2:
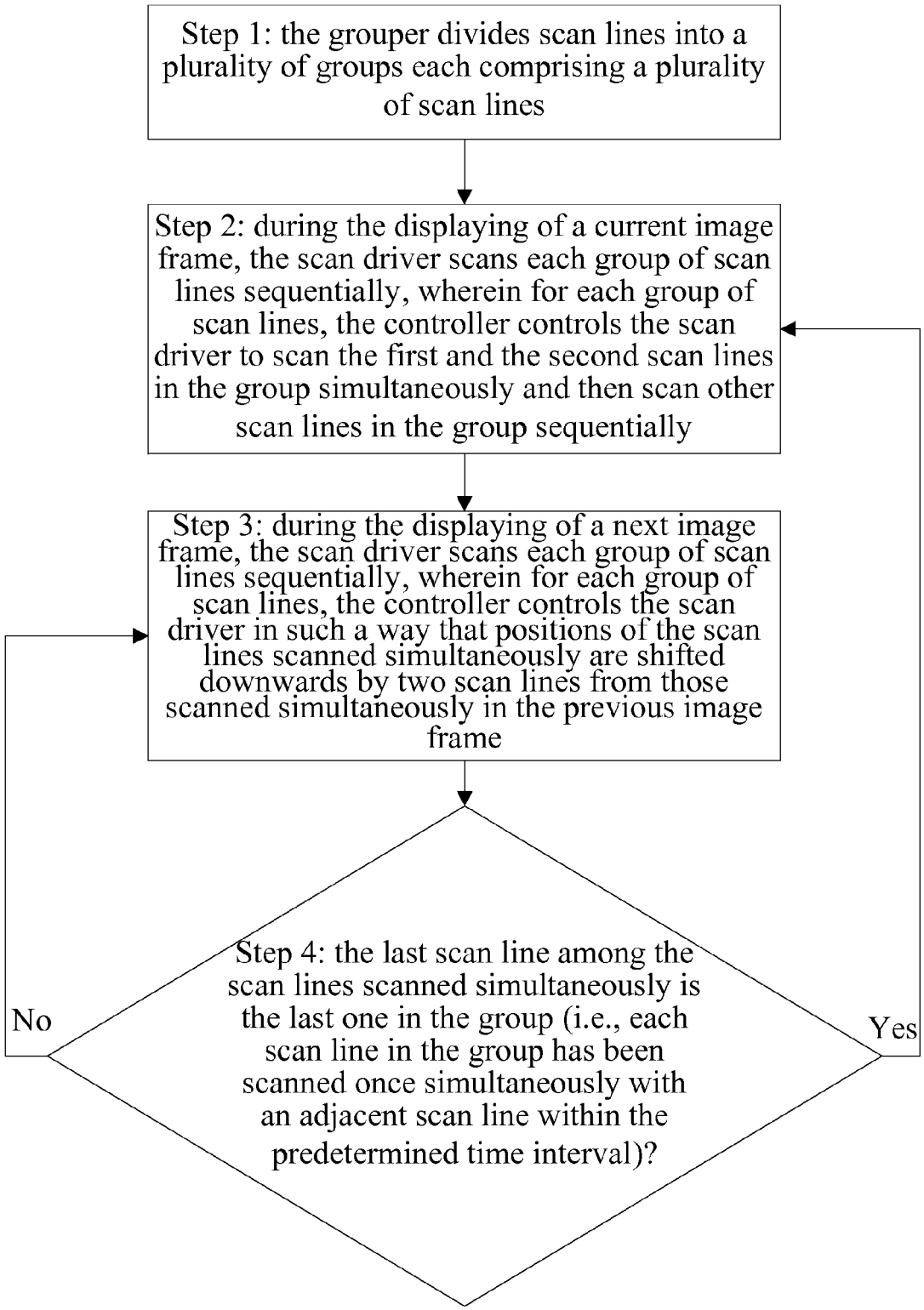
FIG. 2 is a flowchart of a preferred embodiment of an LCD driving method according to the present disclosure.

Referring to FIG. 1 and FIG. 2 together, a preferred embodiment of a driving method for the LCD drive circuit comprises the following steps:

Step 1: the divider divides the scan lines 16 into a plurality of groups each comprising a plurality of scan lines 16.

Step 2: during the displaying of a current image frame, the scan driver 11 scans each group of scan lines 16 sequentially. However, for each group of scan lines 16, the controller 13 controls the scan driver 11 to scan the first scan line 16 and the second scan line 16 in the group simultaneously and scan other scan lines 16 in the group sequentially. When a certain scan line 16 is scanned, TFT switches corresponding to the scan line 16 are turned on at the same time, and meanwhile, the data driver 10 transfers a plurality of grayscale voltages via the plurality of data lines 15 to sources of the turned-on TFT switches. The grayscale voltages are then transferred from the sources of the TFT switches to the pixel electrodes, and then applied to the liquid crystal layer so that predetermined grayscales are displayed.

Step 3: during the displaying of a next image frame, the scan driver 11 scans each group of scan lines 16 sequentially. However, for each group of scan lines 16, the controller 13 controls the scan driver 11 in such a way that positions of scan lines 16 scanned simultaneously are shifted downward by two scan lines 16 from those scanned simultaneously in the previous image frame.

Step 4: if the last scan line 16 among the scan lines 16 scanned simultaneously in the step 3 is the last one in the group (i.e., each of the scan lines 16 in the group has been scanned once simultaneously with an adjacent scan line within the aforesaid predetermined time interval), then the step 2 is executed; otherwise, if the last scan line 16 among the scan lines 16 scanned simultaneously is not the last one in the group, then the step 3 is executed.

In other embodiments of the LCD drive circuit, the number of scan lines 16 scanned simultaneously in each group is not limited to two, and may be greater than two depending on practical needs. That is, the controller 13 may also control the scan driver 11 to, during scanning of each group, scan three or four adjacent scan lines 16 in the group simultaneously, and also control the scan driver 11 in such a way that positions of every three or four adjacent scan lines 16 scanned simultaneously in each image frame are shifted downward by three or four scan lines 16 successively within a predetermined time interval. Here, a magnitude of the predetermined time interval is equal to the number of scan lines 16 in each group divided by three or four.

In other embodiments of the LCD drive method, for each group of scan lines 16, the number of scan lines 16 scanned simultaneously by the scan driver 11 is not limited to two, and may be greater than two, for example, three, four or more. If the number of scan lines 16 scanned simultaneously is three, then for each group of scan lines 16 in the step 2, the first scan line 16, the second scan line 16 and the third scan line 16 in the group are scanned simultaneously and then other scan lines 16 in the group are scanned sequentially; and for each group of scan lines 16 in the step 3, positions of the scan lines 16 simultaneously scanned by the scan driver 11 are shifted downward by three scan lines 16 from those of the previous image frame. Likewise, the LCD driving method can be modified correspondingly when the number of scan lines 16 scanned simultaneously is four.

In other embodiments of the LCD driving method, the scan lines scanned simultaneously in the step 2 are also not limited to the first scan line 16 and the second scan line 16 in each group, but may also be other adjacent scan lines 16 in each group. Correspondingly, shifting of the positions of the scan lines 16 scanned simultaneously in the step 3 is not limited to shifting downward from those of the previous image frame, but may also be changed arbitrarily as long as the adjacent scan lines 16 scanned simultaneously are different from those scanned simultaneously in the previous image frames within the predetermined time interval; furthermore, if each scan line 16 in the group has been scanned once simultaneously with an adjacent scan line within the aforesaid predetermined time interval, then the step 2 is executed; otherwise, the step 3 is executed.

Correspondingly, in other embodiments of the LCD drive circuit, the controller 13 is not limited to control the scan driver 11 in such a way that positions of two adjacent scan lines 16 scanned simultaneously in each image frame are shifted downward successively as long as every two adjacent scan lines 16 scanned simultaneously within the predetermined time interval is different for different image frames.

As compared to the prior art, the LCD driving method of the present disclosure has at least two adjacent scan lines 16 scanned simultaneously in each image frame, so the number of scanning in each image frame is reduced, and the average scanning time of the scan lines 16 is increased to result in an increased charging time of pixel units. Furthermore, every two scan lines 16 scanned simultaneously within the predetermined time interval is scanned simultaneously in only a single image frame and are scanned separately in other image frames; because the time is very short, the frame perceived by the user's eyes can still be kept accurate without being perceived to have errors.

Referring to FIGS. 3 to 6 together, the LCD driving method will be described hereinbelow by taking a case where each group comprises eight scan lines 16 and two scan lines 16 are scanned simultaneously each time as an example.

Step 101: the divider divides the scan lines 16 into a plurality of groups each comprising eight scan lines 16.

Figure 3:
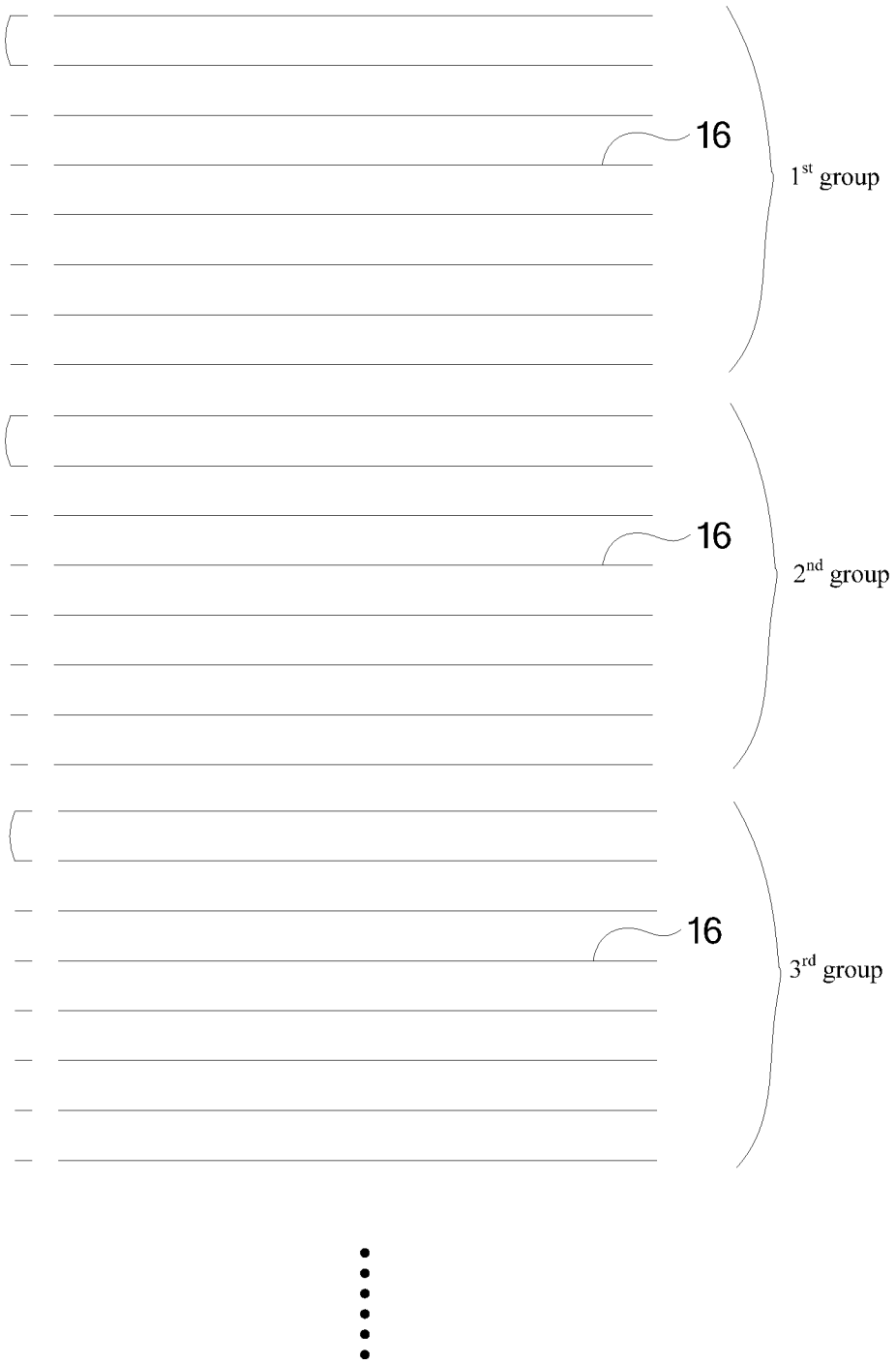
FIGS. 3 to 6 are schematic views illustrating scanning of four exemplary image frames in the LCD driving method according to the present disclosure respectively.

Step 102: during the displaying of the first image frame, the scan driver 11 scans each group of scan lines 16 sequentially; but as shown in FIG. 3, for each group of scan lines 16, the controller 13 controls the scan driver 11 to scan the first scan line 16 and the second scan line 16 in the group simultaneously, and then scan other scan lines 16 in the group sequentially.

When a certain scan line 16 is scanned, TFT switches corresponding to the scan line 16 are turned on at the same time, and meanwhile, the data driver 10 transfers a plurality of grayscale voltages via the plurality of data lines 15 to sources of the turned-on TFT switches. The grayscale voltages are then transferred from the sources of the TFT switches to the pixel electrodes and then applied to the liquid crystal layer so that predetermined grayscales are displayed.

Figure 4:
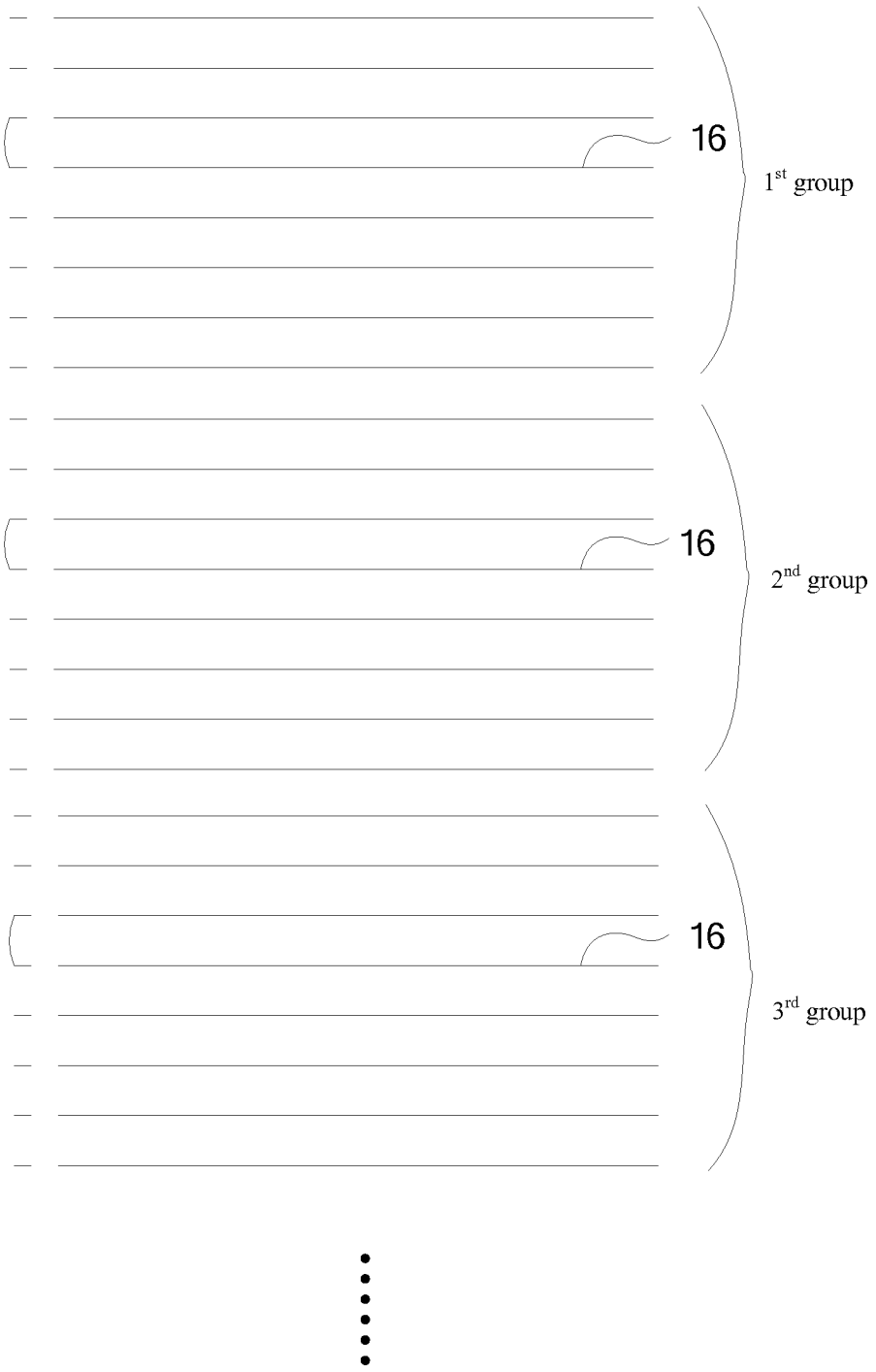

Step 103: during the displaying of the second image frame, the scan driver 11 scans each group of scan lines 16 sequentially; but as shown in FIG. 4, for each group of scan lines 16, the controller 13 controls the scan driver 11 to sequentially scan the first scan line 16 and the second scan line 16, scan the third scan line 16 and the fourth scan line 16 simultaneously, and then sequentially scan other scan lines 16.

Figure 5:
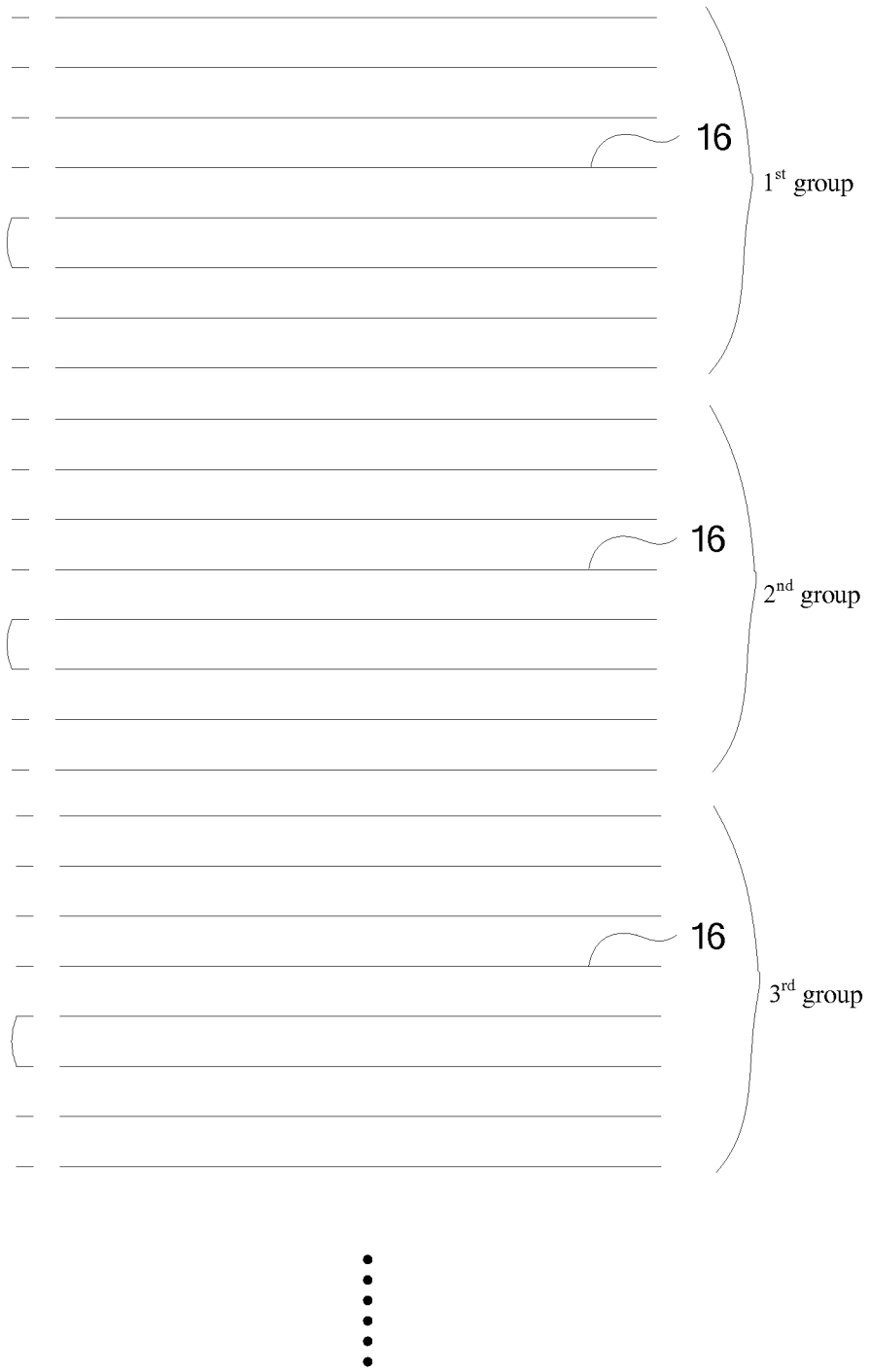

Step 104: during the displaying of the third image frame, the scan driver 11 scans each group of scan lines 16 sequentially; but as shown in FIG. 5, for each group of scan lines 16, the controller 13 controls the scan driver 11 to sequentially scan the first to the fourth scan lines 16, scan the fifth scan line 16 and the sixth scan line 16 simultaneously, and then sequentially scan other scan lines 16.

Figure 6:
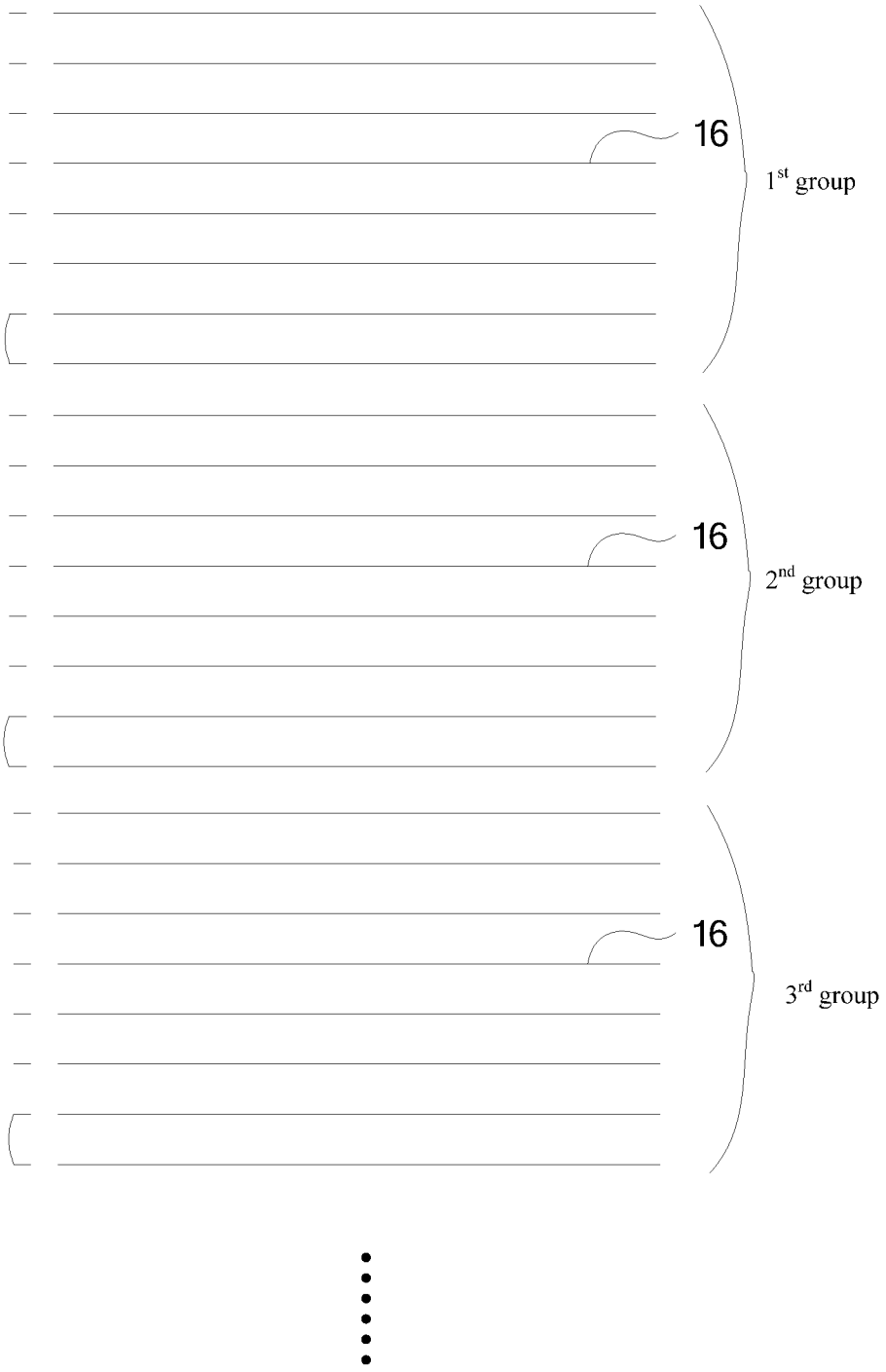

Step 105: during the displaying of the fourth image frame, the scan driver 11 scans each group of scan lines 16 sequentially; but as shown in FIG. 6, for each group of scan lines 16, the controller 13 controls the scan driver 11 to sequentially scan the first to the sixth scan lines 16, and then scan the seventh scan line 16 and the eighth scan line 16 simultaneously. At this point, each of the scan lines 16 in this group has been scanned once simultaneously with an adjacent scan line 16, so the process returns back to the step 102 for a next cycle.

As can be known from the above descriptions, during the displaying of the four consecutive image frames, there are scan lines 16 scanned simultaneously in each image frame, so the number of scanning in each image frame is reduced, and the average scanning time of the scan lines 16 is increased to result in an increased charging time of pixel units. Furthermore, the two scan lines 16 scanned simultaneously in each image frame are different from those in any of the other three image frames. Overall, every two scan lines 16 scanned simultaneously within a predetermined time interval is scanned simultaneously in only a single image frame, and are scanned separately in other three image frames; because the time is very short, the frame perceived by the user's eyes can still be kept accurate without being perceived to have errors.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A liquid crystal display (LCD) drive circuit for scanning at least two adjacent scan lines simultaneously, comprising:

a data driver, a scan driver, a divider, a controller, a plurality of data lines and a plurality of scan lines; wherein the scan driver is connected to the plurality of scan lines;

the data driver is connected to the plurality of data lines;

the divider is configured to divide the scan lines into a plurality of groups each comprising a plurality of scan lines; and the controller is configured to control the scan driver to scan the plurality of groups of scan lines sequentially, wherein the scan driver is controlled to scan at least two adjacent scan lines in each group simultaneously, and scan the remainder of the each group of scan lines sequentially including the last scan line of the at least two adjacent scan lines scanned simultaneously;

the controller is further configured to control the scan driver such that the at least two adjacent scan lines scanned simultaneously within a predetermined time interval are different for different image frames, and positions of the at least two adjacent scan lines scanned simultaneously of each group in a current image frame are different from positions of the at least two adjacent scan lines scanned simultaneously of each group in a next image frame following the current image frame, the positions of the at least two adjacent scan lines scanned simultaneously of each group in the next image frame are shifted downwards from those in the current image frame by a number of the at least two adjacent scan lines scanned simultaneously of each group, wherein the predetermined time interval is in units of image frame durations, and a magnitude of the predetermined time interval is equal to the number of scan lines in each group divided by the number of scan lines scanned simultaneously.

2. The LCD drive circuit of claim 1, wherein:

the divider is configured to divide the scan lines into a plurality of groups each comprising eight scan lines, and the controller is configured to control the scan driver to, during scanning of each group of scan lines, scan two adjacent scan lines in the group simultaneously and also control the scan driver in such a way that every two adjacent scan lines scanned simultaneously in four consecutive image frames is different from each other.

3. The LCD drive circuit of claim 2, wherein:

the controller is configured to control the scan driver in such a way that, within the four consecutive frames, positions of the two adjacent scan lines scanned simultaneously in each of the image frames are shifted downwards by two scan lines from those of a previous image frame.

4. The LCD drive circuit of claim 1, wherein:

the at least two adjacent scan lines scanned simultaneously of a previous group is spaced from the at least two adjacent scan lines scanned simultaneously of a group located next to the previous group with a predetermined number of scan lines, and the predetermined number of scan lines is equal to the number of the remainder scan lines in the each group.

5. An LCD (liquid crystal display) driving method for scanning at least two adjacent scan lines simultaneously, comprising the following steps of:

a. dividing scan lines into a plurality of groups, each group comprising a plurality of scan lines;

b. during displaying of a current image frame, using a scan driver to scan the plurality of groups of scan lines sequentially, wherein for each group of scan lines, the scan driver is controlled by a controller to scan at least two adjacent scan lines in the each group simultaneously, and scan the remainder of the each group of scan lines sequentially including the last scan line of the at least two adjacent scan lines scanned simultaneously;

c. during displaying of a next image frame, using the scan driver to scan the plurality of groups of scan lines sequentially, wherein for each group of scan lines, the controller controls the scan driver such that positions of the at least two adjacent scan lines scanned simultaneously of each group in the current image frame are different from positions of the at least two adjacent scan lines scanned simultaneously of each group in the next image frame following the current image frame, the positions of the at least two adjacent scan lines scanned simultaneously in the next image frame are shifted downwards from those in the current image frame by a number of the at least two adjacent scan lines scanned simultaneously; and d. executing the step b and the step c repeatedly until all available image frames are displayed, wherein the predetermined time interval is in units of image frame durations, and a magnitude of the predetermined time interval is equal to the number of scan lines in each group divided by the number of scan lines scanned simultaneously.

6. The LCD driving method of claim 5, wherein:

in the step c and the step d, the controller controls the scan driver in such a way that positions of the scan lines scanned simultaneously are shifted downwards by at least two scan lines from those scanned simultaneously in the previous image frame, and if the last scan line of the scan lines scanned simultaneously is the last one in the group, then the step d is executed; otherwise, if the last scan line of the scan lines scanned simultaneously is not the last one in the group, then the step c is executed.

7. The LCD driving method of claim 6, wherein:

in the step b, the controller controls the scan driver to scan a first scan line and a second scan line in the group simultaneously and scan other scan lines in the group sequentially; and in the step c, the controller controls the scan driver in such a way that positions of the scan lines scanned simultaneously are shifted downwards by two scan lines from the previous image frame.

8. The LCD driving method of claim 5, wherein:

in the step a, the scan lines are divided into a plurality of groups, each group comprising eight scan lines.

9. The LCD driving method of claim 5, wherein:

in the step b, the at least two adjacent scan lines scanned simultaneously of a previous group is spaced from the at least two adjacent scan lines scanned simultaneously of a group located next to the previous group with a predetermined number of scan lines, and the predetermined number of scan lines is equal to the number of the remainder scan lines in the each group.

* * * * *